US007785146B2

(12) United States Patent
Chazottes et al.

(10) Patent No.: US 7,785,146 B2
(45) Date of Patent: Aug. 31, 2010

(54) LOCKING DEVICE FOR CONNECTOR ELEMENTS AND A CONNECTOR PROVIDED WITH SAID DEVICE

(75) Inventors: Frédéric Chazottes, Epernon (FR); Claude Casses, Clevilliers (FR)

(73) Assignee: FCI, Versailles (FR)

( * ) Notice: Subject to any disclaimer, the term of this patent is extended or adjusted under 35 U.S.C. 154(b) by 41 days.

(21) Appl. No.: 11/664,040

(22) PCT Filed: Sep. 29, 2005

(86) PCT No.: PCT/EP2005/010543

§ 371 (c)(1),
(2), (4) Date: Mar. 28, 2007

(87) PCT Pub. No.: WO2006/034865

PCT Pub. Date: Apr. 6, 2006

(65) Prior Publication Data

US 2008/0070441 A1 Mar. 20, 2008

(30) Foreign Application Priority Data

Sep. 29, 2004 (FR) ..... 04 52187

(51) Int. Cl.
*H01R 13/40* (2006.01)

(52) U.S. Cl. ..... 439/595; 439/752

(58) Field of Classification Search ..... 439/595, 439/752, 753, 353, 357
See application file for complete search history.

(56) References Cited

U.S. PATENT DOCUMENTS

| | | | | |
|---|---|---|---|---|
| 4,544,220 | A | 10/1985 | Aiello et al. | 339/59 |
| 4,708,413 | A | 11/1987 | Schroeder | 439/358 |
| 4,867,699 | A | 9/1989 | Oda et al. | 439/355 |
| 4,944,688 | A | 7/1990 | Lundergan | 439/275 |
| 5,059,142 | A | 10/1991 | Ohta et al. | 439/752 |
| 5,071,369 | A | 12/1991 | Denlinger et al. | 439/595 |
| 5,145,356 | A | 9/1992 | Minnis | 439/352 |
| 5,496,194 | A | 3/1996 | Huss, Jr. | 439/595 |
| 5,575,685 | A | 11/1996 | Ittah et al. | 439/595 |
| 5,605,472 | A | 2/1997 | Sakai et al. | 439/489 |
| 5,622,521 | A | 4/1997 | Marceau et al. | 439/595 |
| 5,628,648 | A | 5/1997 | Higgins, Jr. et al. | 439/489 |
| 5,643,003 | A | 7/1997 | Myer et al. | 439/352 |
| 5,643,009 | A | 7/1997 | Dinkel et al. | 439/595 |
| 5,681,178 | A | 10/1997 | Kunkle et al. | 439/352 |
| 5,730,625 | A | 3/1998 | Sikora | 439/595 |
| 5,913,697 | A | 6/1999 | Myer et al. | 439/595 |
| 5,928,038 | A | 7/1999 | Berg et al. | 439/752 |
| 5,947,763 | A | 9/1999 | Alaksin | 439/489 |
| 5,964,621 | A | 10/1999 | Wolla et al. | 439/595 |
| 6,004,153 | A | 12/1999 | Myer et al. | 439/352 |
| 6,045,404 | A | 4/2000 | Myer | 439/595 |
| 6,056,604 | A | 5/2000 | Roy et al. | 439/845 |
| 6,247,975 | B1 | 6/2001 | Cue | 439/845 |
| 6,261,115 | B1 | 7/2001 | Pederson et al. | 439/352 |
| 6,383,009 | B2 * | 5/2002 | Kawase et al. | 439/352 |
| 6,406,319 | B2 | 6/2002 | Pederson et al. | 439/352 |
| 6,419,515 | B1 | 7/2002 | Okayasu | 439/358 |
| 6,494,750 | B2 * | 12/2002 | Morita et al. | 439/752 |
| 6,514,098 | B2 | 2/2003 | Marpoe, Jr. et al. | 439/352 |
| 6,692,288 | B2 * | 2/2004 | Nimura | 439/352 |
| 6,811,437 | B2 * | 11/2004 | Nimura | 439/595 |
| 6,827,609 | B1 | 12/2004 | Martin et al. | 439/595 |
| 6,913,494 | B2 | 7/2005 | Ward et al. | 439/752 |
| 7,201,599 | B2 | 4/2007 | Holub | 439/357 |
| 7,387,545 | B2 | 6/2008 | Tyler et al. | 439/752 |
| 2001/0027058 | A1 | 10/2001 | Pederson et al. | 439/595 |
| 2004/0087209 | A1 * | 5/2004 | Nakamura | 439/595 |
| 2005/0176298 | A1 * | 8/2005 | Flowers et al. | 439/595 |
| 2005/0227548 | A1 | 10/2005 | Sian | 439/752 |
| 2005/0266738 | A1 | 12/2005 | Martin et al. | 439/751 |
| 2006/0141862 | A1 * | 6/2006 | Machida et al. | 439/595 |
| 2006/0281373 | A1 * | 12/2006 | Anbo et al. | 439/752 |

FOREIGN PATENT DOCUMENTS

| | | | |
|---|---|---|---|
| EP | 0716473 | A1 | 6/1996 |
| EP | 0 967 694 | A2 | 12/1999 |
| EP | 0967686 | A1 | 12/1999 |
| EP | 1005113 | B1 | 7/2003 |
| EP | 1 351 339 | A1 | 10/2003 |
| JP | 11086950 | A | 3/1999 |

* cited by examiner

*Primary Examiner*—Hien Vu
(74) *Attorney, Agent, or Firm*—Harrington & Smith

(57) ABSTRACT

The invention relates to a device for locking a cap onto a contact-carrier module, wherein said cap has a bearing for locking the contact disposed in the contact-carrier module is assembled on the coupling face of module in such a way that the cap and the module form a first connector element which includes a latch for latching the cap on the module in a longitudinal contact locking position and a removable stop preventing the coupling of the connector element with a complementary connector element until the cap is latched on the module in the contact locking position.

17 Claims, 3 Drawing Sheets

LOCKING DEVICE FOR CONNECTOR ELEMENTS AND A CONNECTOR PROVIDED WITH SAID DEVICE

The present invention relates to a connector element locking device and a connector that is provided with said device.

Electrical connectors, notably in their automobile applications, contain contact-locking devices that assure that the contacts are firmly held in their sockets.

These locking devices frequently have a mobile part such as a front cap comprising a front face, provided with holes for passage of the contact pins that will be coupled with complementary female contacts, and lateral walls enclosing the lateral faces of a contact-carrier module.

The cap/module assembly thus constitutes a first connector element bearing contacts of a first type designed to be coupled with a second connector element bearing contacts of a second type, complementary to the first type.

In order to permit repairing the connector and being able to detect a poorly inserted contact, the cap can move between a contact insertion/extraction position and a contact locking position.

It is necessary to make the functioning of connectors secure and, before complementary connector elements are coupled, to guarantee, on the one hand, that the contacts are correctly inserted, and, on the other hand, that the contact locking devices are in their locking position.

In order to do this, the present invention seeks to propose a device for locking a cap onto a contact-carrier module, wherein the cap bearing means for locking the contacts disposed in the contact-carrier module is assembled onto the coupling face of the contact-carrier module in such a way that the cap and the module form a first connector element, characterized in that it has means for latching the cap onto the module in a longitudinal position for locking the contacts, and removable stop means that prevent the connector element from being coupled with a complementary connector element as long as the cap is not latched onto the module in the contact locking position.

According to the invention, the latching means comprise, in particular, a lever provided with at least one locking finger, the removable stop means advantageously comprising a first arm of the lever.

In order to latch the cap in the contact locking position, the device can comprise a first locking finger, and the device can also comprise a second locking finger that latches the cap onto the contact-carrier module in a contact insertion/extraction position.

In an alternative embodiment, the device comprises a locking finger that, when it is in a first position, latches the cap onto the contact-carrier module in the contact locking position, and, when it is in a second position, latches the cap in a contact insertion/extraction position.

Figure 1:
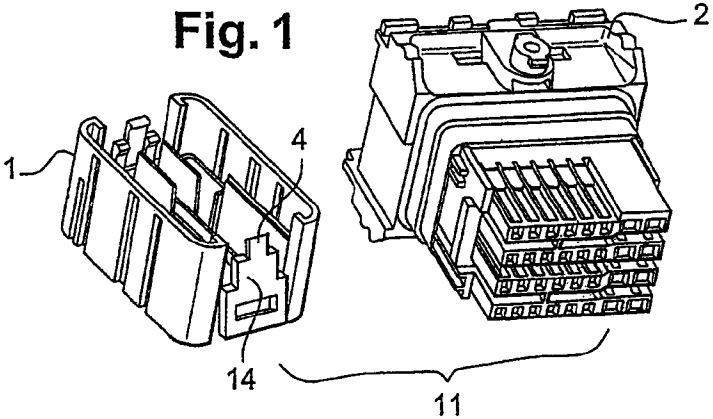
Figure 2B:
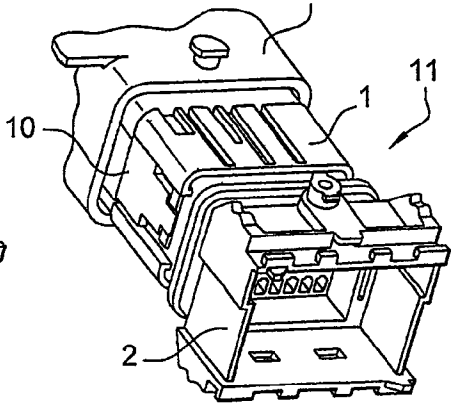
Figure 2A:
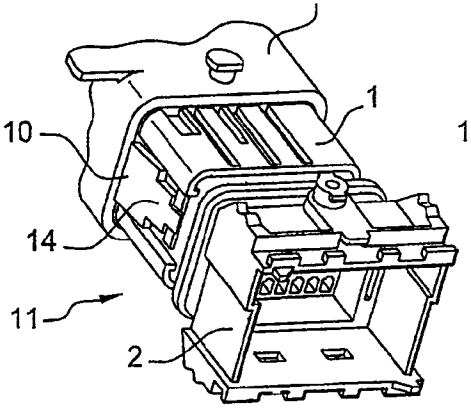
Figure 3A:
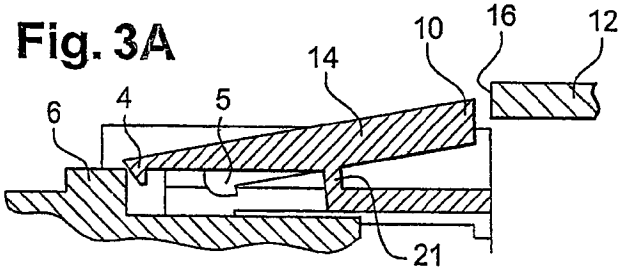
Figure 3B:
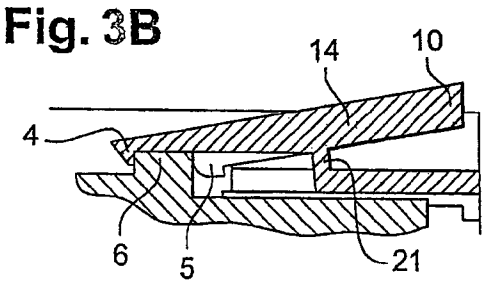
Figure 3C:
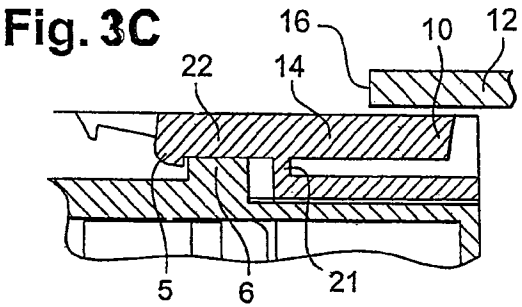
Figure 4:
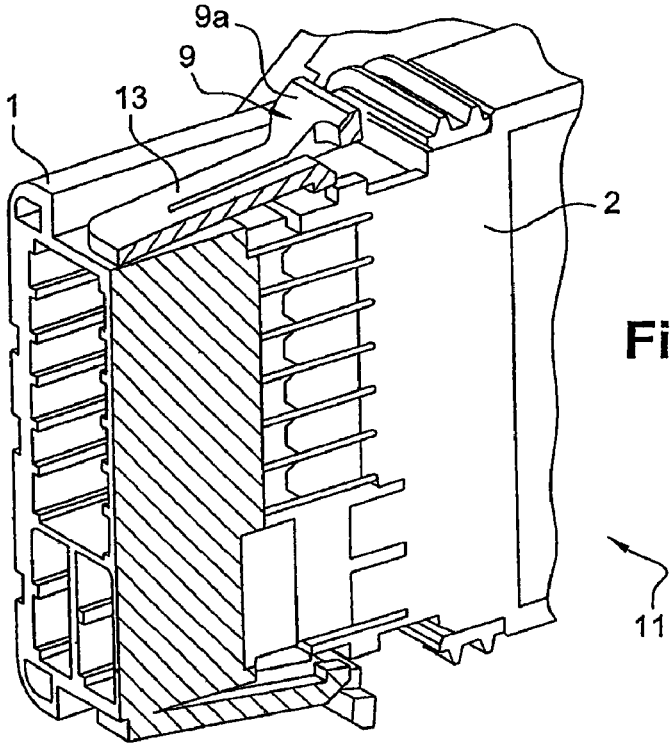
Figure 6:
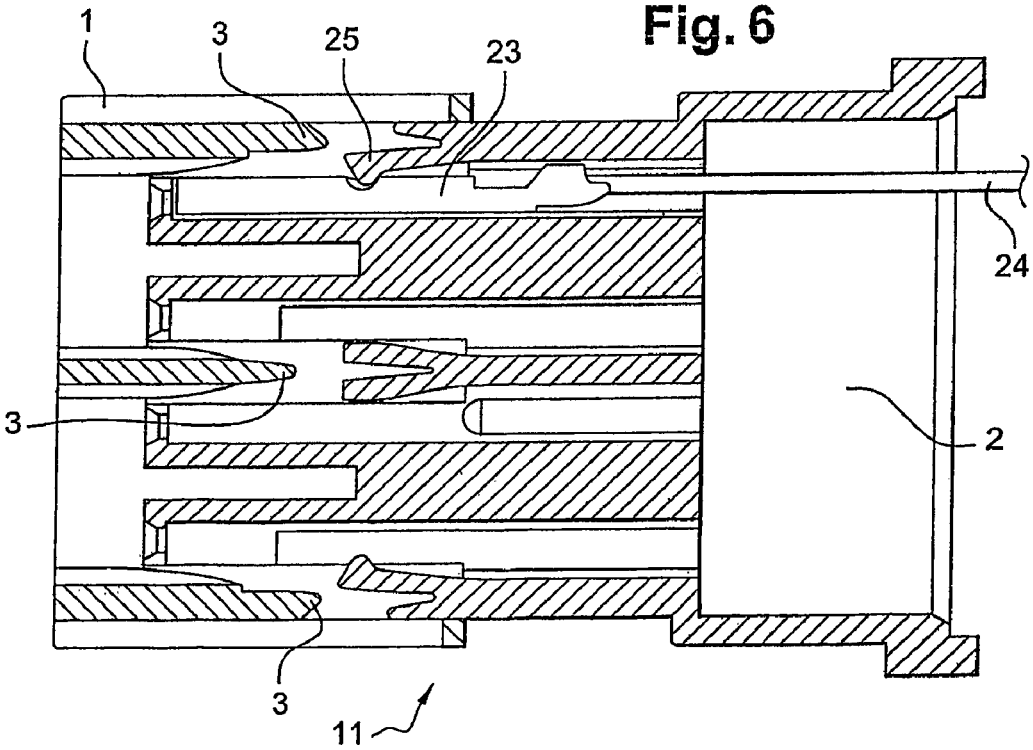
Figure 5A:
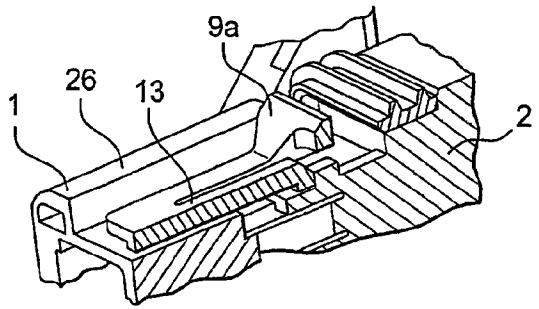
Figure 5B:
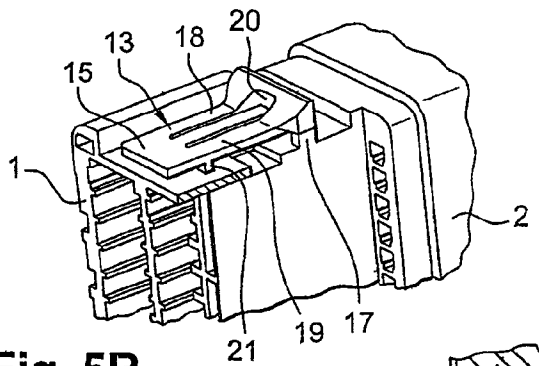
Figure 5C:
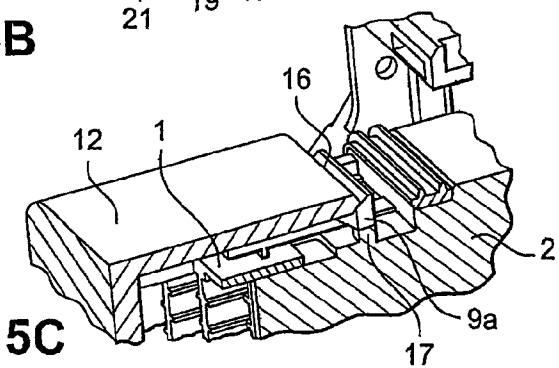
Figure 5D:
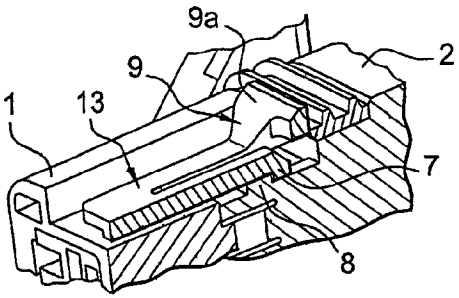
Figure 5E:
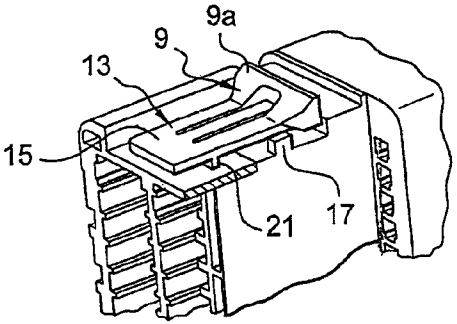
Figure 5F:
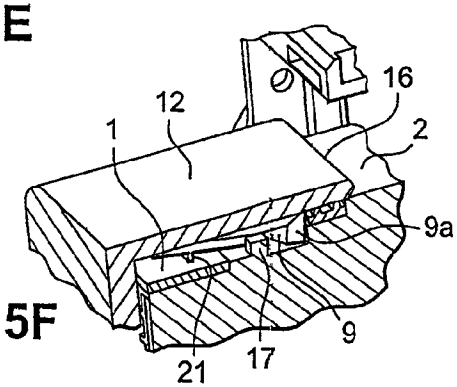

Other characteristics and advantages of the invention will be better understood upon reading the description that will follow of examples of embodiment of the invention in reference to the figures, which show:

In FIG. 1: A perspective view of a cap and a contact-carrier module according to a first example of embodiment of the invention;

In FIGS. 2A and 2B: Perspective views of the example of embodiment of FIG. 1 in position before coupling with a complementary connector element;

In FIGS. 3A, 3B and 3C: Sectional views of details of the locking device according to the example of FIG. 1, respectively, in the position before mounting, in the contact insertion/extraction position and in the contact locking position;

In FIG. 4: A sectional perspective view of a module and a cap according to a second example of embodiment;

In FIGS. 5A to 5F: Partial sectional perspective views, in various functioning positions, of a device according to FIG. 4;

In FIG. 6: A sectional view of a cap and a contact-carrier module according to the invention.

The object of the invention is to create a device that prevents the coupling of a first connector element comprising a contact-carrier module and a cap protecting the front part of the first connector element, with a second complementary connector element, in the case where the first connector element is not correctly assembled.

FIG. 1 shows a general view of such a first connector element provided with a cap 1 and a contact-carrier module 2, making up the first connector element 11 after assembly.

A section of the connector element cap mounted on the module is shown in FIG. 6.

According to this example, cap 1 bears means 3 for locking contacts 23 positioned in the contact-carrier module and connected to a cable 24.

Locking means 3 are here secondary locking means for the contacts and are pressing on contact retaining tabs 25.

An embodiment for which locking means 3 are directly held on the contacts can be envisioned according to the invention.

According to the example, the cap is designed to be assembled on the coupling face of contact-carrier module 2 in order to form first connector element 11.

The cap is shown in FIG. 6 in a contact insertion/extraction position, means 3 not yet resting on the tabs, so that these tabs can hold the contacts in position, but can release the contacts if the cable is pulled sufficiently hard or if the tab is lifted by its front part.

Returning to FIG. 1, a first example of embodiment of the cap locking device according to the invention is shown. The locking device here has a lever 14 of one piece with the cap and pivoting around a lateral face of the cap.

This first example of embodiment is detailed more precisely in FIGS. 3A to 3B, and its use is shown in FIGS. 2A and 2B, which show the connector element of FIG. 1 when it is coupled with a complementary connector element 12.

The device for locking cap 1 onto contact-carrier module 2 shown in FIGS. 3A to 3C has means 4, 5, 6, 14 for latching cap 1 onto module 2.

These latching means permit positioning the cap on the module in a longitudinal contact insertion/extraction position as well as in a longitudinal contact locking position.

According to the embodiment of FIG. 1, the means for latching the cap onto the module comprise a lever 14 provided with at least one locking finger 4.

According to the embodiment of FIGS. 3A to 3C, lever 14 is provided with two locking fingers 4 and 5.

The one or more locking fingers permit(s) latching the cap onto the module in the contact insertion/extraction position and in the contact locking position described above.

In the case of the device with a single locking finger such as shown in FIG. 1, the contact insertion/extraction position can be a position that does not block the cap.

In the versions with two locking fingers shown in FIGS. 3A to 3C, the first position is a stable position for which a first finger 4 is latched onto a stud 6 in order to position the cap in the contact insertion/extraction position, the lever remaining in an inclined position for which a rear arm 10 of the lever passes through the outer footprint of the cap to interfere with a projecting part 16 of complementary connector element 12.

The first locking finger here is connected to the lever bearing a second locking finger, but, in an alternative version, can be separate from this lever.

In order to prevent a coupling of the connector elements, the device has removable stop means that prevent the coupling of the connector element with the complementary connector element until the cap is latched in the contact locking position onto the module, that is to say, when the cap is still not in the contact locking position.

According to the example of embodiment of FIGS. 3A to 3C, the removable stop means are made up of the end of arm 10.

This arm is a manipulating handle of the lever, which is opposite a second lever arm bearing locking fingers 4, 5, relative to a rotation point 21 of lever 14.

In the position of FIGS. 2A and 3B, arm 10 interferes with projecting part 16 of complementary connector element 12 and prevents a coupling of connector elements 11, 12.

In FIG. 3A, cap 1 is pre-mounted on module 2, while in FIG. 3B, cap 1 is in the contact insertion/extraction position.

As indicated previously, the example of FIGS. 3A to 3C is a device having two locking fingers, finger 4 for the contact insertion/extraction position, finger 5 for the contact locking position.

In order to reach the contact locking position shown in FIG. 3C, it is necessary to push cap 1 while possibly pressing manipulating handle 10 until this locking finger 5 is latched behind stud 6 after passage on stud 6 into a retaining cavity of cap 1, this cavity here being made up by the space behind stud 6.

The cap is then in the contact locking position and, in this position, arm 22 bearing locking finger 5 rests on stud 6 so that lever 14 is bent and lowers the first arm 10 into a position that does not interfere with said projecting part of complementary connector 12.

Thus, the connector elements can be coupled in the contact locking position and only in this position.

By referring to FIG. 6, one notes that one function of the device is to detect a poorly inserted contact.

In fact, in the case of a contact poorly inserted in its socket, corresponding tab 25 bumps into the contact body and is pushed away from its position of being latched in the contact.

In such a situation, cap locking element 3 bumps into tab 25 in its turn, which prevents positioning the cap in the contact locking position.

In such a case, the removable stop means comprising the first arm 10 of lever 14 cannot be removed, which renders a coupling of the connector elements impossible, and thus permits detecting the poor insertion of at least one contact.

Such an embodiment is particularly sought after in the automobile field, in which it is desired to detect poor mounting in the production line, while preventing the mounting of connectors whose contacts are incorrectly inserted.

Another embodiment of the invention is notably shown in FIGS. 5A to 5F.

According to this embodiment, cap 1 also has a locking lever 13 and removable stop means comprising a first arm 9 of lever 13.

In contrast, according to this embodiment, first arm 9 is contiguous with a locking finger 7 that assures locking the cap onto the module in the contact locking position.

First arm 9 here is opposite a manipulating handle 15 of lever 13 relative to a rotation point 21 of lever 13, and has a protuberance 9*a* at its end.

The removable stop means comprise protuberance 9*a* of first arm 9, which interferes with a projecting part 16 of the complementary connector element and prevents the coupling of connector elements 11, 12 when the cap is not in the locked position on module 2.

In order to do this and to hold first arm 9 in the interference position, the stop means also comprise a counter-stop 17 on module 2.

The counter-stop is positioned so that in the contact insertion/extraction position, a lower segment of the first arm 9 rests on counter-stop 17, which thus prevents the bending of lever 13.

As soon as cap 1 has been pushed into the contact locking position, the segment is offset beyond counter-stop 17.

Protuberance 9*a* can thus be removed from a position of interference with said projecting part of complementary connector 12 by bending lever 13.

In order to conserve a different elasticity between locking finger 7 and first arm 9, the first arm is separated from finger 7. The first arm has two longitudinal branches 18, 19 and a cross-bridge 20, longitudinal branches 18, 19 framing locking finger 7, and cross-bridge 20 being situated on top of finger 7.

Thus, the device according to the invention can comprise a first locking finger 4 that latches the cap in the contact insertion/extraction position, and a second locking finger 5 that latches the cap in the contact locking position on the contact-carrier module, or can comprise a single locking finger 7 that latches the cap in the insertion/extraction position as well as in the position for locking onto the contact-carrier module.

The versions for which the arm making up the stop means is opposite the arm bearing the locking fingers relative to a pivoting point 21 of the lever permit detecting when the cap is not in place at the beginning of the connection with the complementary connector element.

The version for which the arm forming the stop means is found on the same side as the locking fingers permits creating a less cumbersome cap, for which manipulating handle 15 is protected in the footprint of the cap between longitudinal partitions 26 on the cap. The invention is not limited to the examples of embodiment shown, and notably stud 6 can be in the form of a cross-piece.

Moreover, the insertion/extraction and locking positions can be obtained by latching the fingers in a succession of cavities separated by gaps; therefore, the lever making up part of the stop means according to the example of embodiment of FIG. 5 can be a separate lever from the lever bearing the one or more locking pieces.

The invention claimed is:

1. A device for locking a cap onto a contact-carrier module, wherein the cap comprises means for locking contacts disposed in the contact-carrier module, wherein the cap is configured to be assembled onto a coupling face of the contact-carrier module so that the cap and the contact-carrier module form a first connector element, wherein the device has means formed on the cap for latching the cap onto the contact-carrier module in a longitudinal contact locking position, wherein the device comprises removable stop means formed on the cap configured to directly prevent coupling of the first connector element with a complementary connector element when the cap is not latched in the contact locking position, wherein the removable stop means is spaced from the means for locking the contacts.

2. The locking device according to claim 1, further characterized in that the latching means comprise a lever provided with at least one locking finger.

3. The locking device according to claim 1, further characterized in that the removable stop means comprise a first arm of a lever.

4. The locking device according to claim 3, further characterized in that said first arm is contiguous with a locking finger.

5. The locking device according to claim 3, further characterized in that said first arm is opposite a manipulating handle of the lever relative to a rotation point for the lever.

6. The locking device according to claim 3, further characterized in that said first arm has two longitudinal branches and a cross-bridge, wherein the longitudinal branches framing the locking finger.

7. The locking device according to claim 3, further characterized in that said first arm is a manipulating handle of the lever, wherein the first arm is opposite a second lever arm, bearing said locking finger, relative to a rotation point of the lever.

8. The locking device according to claim 3, further characterized in that when the cap is not in the contact locking position, the first arm interferes with a projecting part of the complementary element and prevents the coupling of the connector elements.

9. The locking device according to claim 3, further characterized in that a locking finger of the lever is latched, after a stud passes into a retaining cavity of the cap in the contact locking position, the arms bearing the locking finger then resting on the stud so that the lever bends and lowers the first arm into a position in which the lever does not interfere with said projecting part of the complementary connector.

10. The locking device according to claim 1, wherein the locking device has a first locking finger configured to latch the cap in the contact locking position, and a second locking finger configured to latch the cap onto the contact-carrier module in a contact insertion/extraction position.

11. The locking device according to claim 1, wherein the locking device has a locking finger configured to latch the cap onto the contact-carrier module in the contact locking position when it is in a first position, and configured to latch the cap in a contact insertion/extraction position when it is in a second position.

12. A locking device for locking a cap onto a contact-carrier module, wherein the cap comprises means for locking contacts disposed in the contact-carrier module, wherein the cap is configured to be assembled onto a coupling face of the contact-carrier module so that the cap and the contact-carrier module form a first connector element, wherein the device has means for latching the cap onto the contact-carrier module in a longitudinal contact locking position, wherein the device comprises movable stop means formed on the cap that prevent coupling of the first connector element with a complementary connector element when the cap is not latched in the contact locking position, wherein the movable stop means formed on the cap comprise a first arm of a lever, further characterized in that when the cap is not in the contact locking position, the movable stop means comprise a protuberance of said first arm which interferes with a projecting part of the complementary connector element and prevents the coupling of connector elements, and a counter-stop on the module on which rests a segment of said first arm, wherein the counter-stop opposing the bending of the lever.

13. The locking device according to claim 12, further characterized in that, when the cap is in the contact locking position, said segment is offset relative to the counter-stop, and the protuberance can then be in a position of not interfering with said projecting part of the complementary connector by bending the lever.

14. An electrical connector housing comprising:

a contact-carrier module having electrical terminal receiving areas, wherein the electrical terminal receiving areas are configured to receive electrical contacts; and a terminal position assurance (TPA) member formed as a cap movably mounted to the electrical connector housing, wherein the TPA member is latched to the electrical connector housing in a pre-lock position by lateral side latches of the TPA member, wherein the side latches each comprise a latching lever having a first section configured to be deflected in an inward direction to pivot the latching lever on a rotation point and thereby deflect a second section of the latching lever outward to un-latch the TPA member from the pre-lock position, wherein the TPA member is configured to be mounted on a front side of the contact-carrier module from a front direction relative to the contact-carrier module, wherein the latching lever is connected to the TPA member by only the rotation point, and wherein the rotation point extends directly from a bottom side of the latching lever to connect to the TPA member.

15. An electrical connector housing as in claim 14 wherein the lateral side latches of the TPA member are configured to latch the TPA in a final latched position with the TPA located further inward on the front side of the contact-carrier module than at the pre-lock position.

16. An electrical connector comprising:

an electrical connector housing as in claim 14; and an electrical contact mounted in one of the electrical terminal receiving areas, wherein the TPA member is attached to the contact-carrier module and prevents a contact retaining tab of the contact-carrier module from deflecting away from engagement with the electrical contact.

17. A locking device for locking a cap onto a contact-carrier module, wherein the cap is configured to be assembled onto a coupling face of contact-carrier module so that the cap and the module form a first connector element, wherein the cap comprises a lock configured to lock contacts disposed in the contact-carrier module, wherein the locking device formed on the cap comprises a latch for latching the cap onto contact-carrier module in a longitudinal contact locking position, and wherein the locking device comprises a movable stop formed on the cap, spaced from the lock, configured to directly prevent coupling of the first connector element with a complementary second connector element when the cap is not latched in the longitudinal contact locking position.

* * * * *